US008181893B2

(12) United States Patent
Ruthardt

(10) Patent No.: US 8,181,893 B2
(45) Date of Patent: May 22, 2012

(54) FUEL INJECTION VALVE

(75) Inventor: Siegfried Ruthardt, Altdorf (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/908,157

(22) PCT Filed: Mar. 3, 2006

(86) PCT No.: PCT/EP2006/060423

§ 371 (c)(1),
(2), (4) Date: Sep. 10, 2007

(87) PCT Pub. No.: WO2006/106021

PCT Pub. Date: Oct. 12, 2006

(65) Prior Publication Data

US 2008/0185462 A1 Aug. 7, 2008

(30) Foreign Application Priority Data

Apr. 6, 2005 (DE) ..... 10 2005 015 735

(51) Int. Cl.
*B05B 1/00* (2006.01)
*F02M 47/02* (2006.01)

(52) U.S. Cl. ..... 239/600; 239/589; 239/594; 239/533.2; 239/88

(58) Field of Classification Search ..... 239/88–92, 239/533.2–533.15, 589, 594, 600
See application file for complete search history.

(56) References Cited

U.S. PATENT DOCUMENTS

| | | | | |
|---|---|---|---|---|
| 4,627,571 | A * | 12/1986 | Kato et al. | 239/90 |
| 6,390,385 | B1 * | 5/2002 | Hardy et al. | 239/102.2 |
| 6,422,208 | B1 * | 7/2002 | Ertem et al. | 123/467 |
| 6,601,784 | B2 * | 8/2003 | Muller-Girard et al. | 239/585.1 |
| 6,845,756 | B2 * | 1/2005 | Ruthardt et al. | 123/467 |
| 7,014,130 | B2 * | 3/2006 | Maier et al. | 239/533.2 |
| 7,258,283 | B2 * | 8/2007 | Heinz et al. | 239/88 |
| 7,451,938 | B2 * | 11/2008 | Cooke | 239/102.2 |
| 2002/0014540 | A1 | 2/2002 | Cooke | |

FOREIGN PATENT DOCUMENTS

| | | | |
|---|---|---|---|
| DE | 100 62 960 | A1 | 6/2002 |
| DE | 10062960 | A1 * | 6/2002 |
| DE | 10346209 | A1 * | 4/2005 |
| EP | 1 174 615 | A2 | 1/2002 |
| JP | 62169257 | U | 10/1987 |
| JP | 10259889 | A | 9/1998 |
| JP | 2000161176 | A | 6/2000 |
| JP | 2001221128 | A | 8/2001 |
| JP | 200451885 | A | 6/2004 |
| JP | 200451889 | A | 6/2004 |
| WO | WO 2005/098229 | A1 | 10/2005 |

* cited by examiner

*Primary Examiner* — Len Tran
*Assistant Examiner* — James Hogan
(74) *Attorney, Agent, or Firm* — Ronald E. Greigg

(57) ABSTRACT

A fuel injection valve for internal combustion engines has a valve housing composed of a first housing part and a second housing part which are connected to one another in a connecting region. In order to improve the strength of the connection in relation to the pressure of the fuel which prevails in an inner space, the housing wall of the first housing part is supported in the connecting region on the housing wall of the second housing part, and the housing wall of the second housing part is of reinforced design in the connecting region.

9 Claims, 1 Drawing Sheet

FUEL INJECTION VALVE

CROSS-REFERENCE TO RELATED APPLICATION

This application is a 35 USC 371 application of PCT/EP 2006/060423 filed on Mar. 3, 2006.

BACKGROUND OF THE INVENTION

1. Field of the Invention

The invention relates to a fuel injection valve for fuel injection systems of internal combustion engines. In particular, the invention relates to an injector for fuel injection systems of air-compressing, auto-ignition engines.

2. Description of the Prior Art

DE 101 64 123 A1 has disclosed a fuel injection valve for the direct injection of diesel fuel into an internal combustion engine. The known fuel injection valve has a valve housing that is composed of a plurality of housing parts and is connected to a fuel inlet fitting. Inside the valve housing, a fuel-carrying conduit is provided, which feeds into a pressure chamber that is provided inside the valve housing, downstream in the injection direction from a stroke-boosting device of the fuel injection valve. Because of the high pressure of the fuel, powerful forces are exerted in the region of the conduit, for which reason the housing parts are embodied as solid, particularly in the vicinity of the fuel conduit. The housing parts of the valve housing are also embodied as solid in the region of a control chamber that contains highly pressurized fuel during operation of the fuel injection valve.

The fuel injection valve known from DE 101 64 123 A1 therefore has the disadvantage of requiring a high degree of production complexity and a significant consumption of material and also increasing the size of the fuel injection valve in relation to the usable interior volume. The embodiment of the conduit for conveying fuel into the pressure chamber provided downstream of the stroke-boosting device also contributes to increasing the size of the fuel injection valve.

SUMMARY AND ADVANTAGES OF THE INVENTION

The fuel injection valve according to the invention has the advantage over the prior art that it is possible to assure the stability of the valve housing of the fuel injection valve while also optimizing the consumption of material. In particular, the seal between the housing parts of the valve housing is improved. It is thus possible to achieve the same stability as the prior art, with less production complexity and in particular less consumption of material and it is also possible to reduce the installation space required for the fuel injection valve.

Advantageous modifications of the fuel injection valve are disclosed. In an advantageous fashion, the housing wall of the first housing part and the housing wall of the second housing part delimit an inner chamber of the valve housing, which chamber contains highly pressurized fuel during operation of the fuel injection valve. It is thus possible to convey the fuel directly through the inner chamber of the valve housing without requiring an additional fuel conduit. The embodiment according to the invention assures the sealing action of the interface between the two housing parts of the valve housing.

It is advantageous that the first housing part is attached to the second housing part by means of a retaining nut. It is also advantageous that the first housing part has an external thread, the retaining nut has an internal thread, the internal thread of the retaining nut engages in order to attach the first housing part to the second housing part, and the retaining nut is embodied so as to produce the most uniform possible transmission of force by means of the engaged thread turns of the first housing part and of the retaining nut. In a conventional screw connection, the majority of the retaining force is exerted by the first thread turns. Through a suitable geometrical design of the retaining nut, however, the stresses generated by the high pressure of the fuel can be optimized, in particular distributed uniformly, so that stress peaks are avoided and a uniform stress load occurs, which additionally reduces the occurrence of stresses generated by the internal pressure. The design of the retaining nut can be determined through a process that makes use of the finite element method. In particular, at least in the region of the front engaged thread turns, the retaining nut can have a narrower wall thickness than in the region of the rear engaged thread turns.

It is advantageous that the second housing part has a conical support shoulder and that the first housing part rests against the support shoulder. This achieves an advantageous support of the first housing part in the radial direction in which the internal fuel pressure adds to the sealing force and thus assists in the sealing function at the interface between the housing parts.

The second housing part advantageously has a greater wall thickness in the connecting region than the first housing part, which further improves the supporting action. Alternatively or in addition, the second housing part can be composed of a material that has an increased strength. The second housing part can, for example, be made of a high-alloy steel so that the production complexity and production costs are optimized in relation to the manufacture of the entire fuel injection valve.

BRIEF DESCRIPTION OF THE DRAWING

A preferred exemplary embodiment of the invention will be explained in greater detail herein below, in conjunction with the single drawing FIGURE which is an axial section through an exemplary embodiment of the fuel injection valve according to the present invention.

DESCRIPTION OF THE PREFERRED EMBODIMENT

Figure 1:
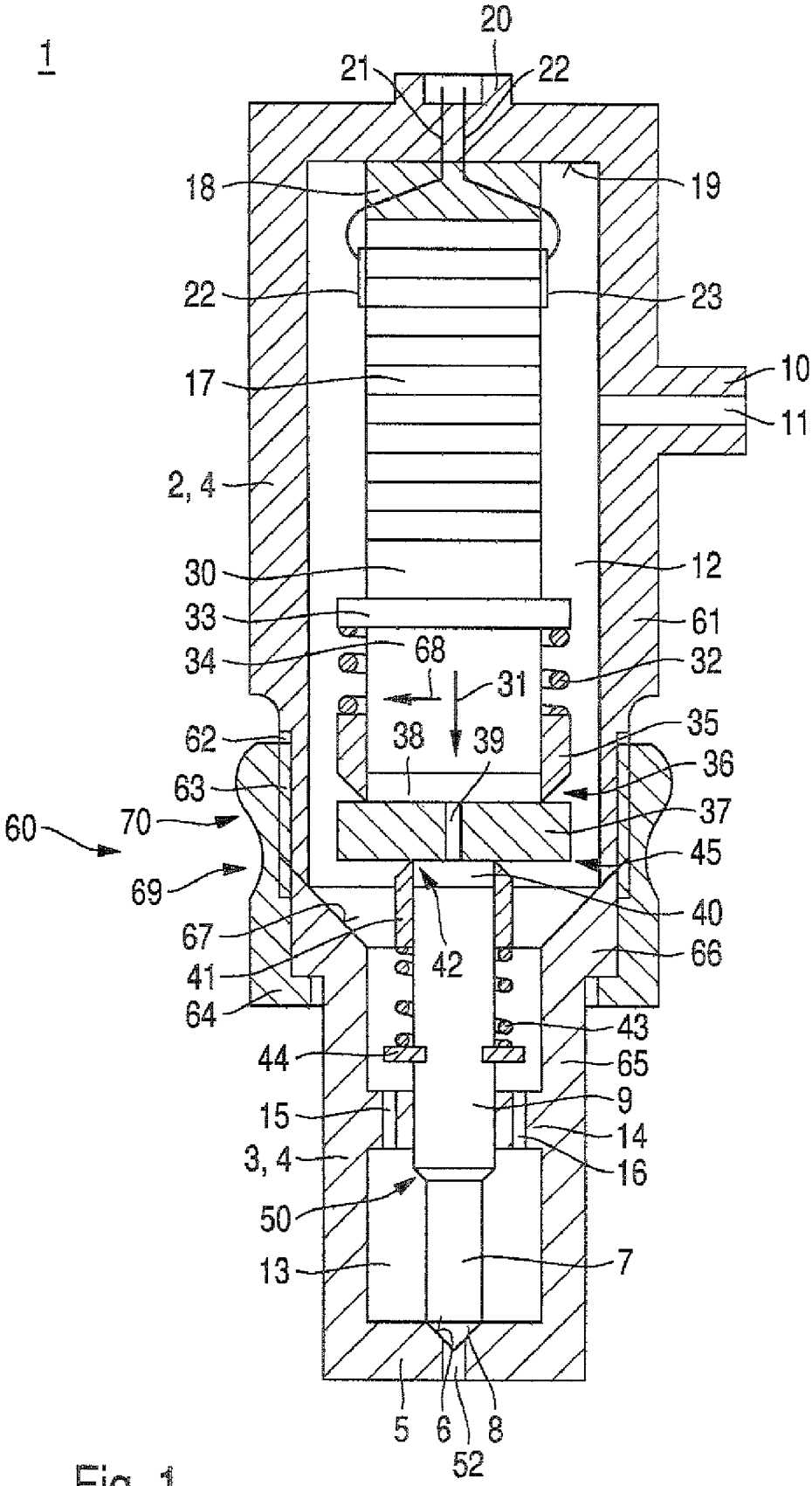
FIG. 1 is an axial section through an exemplary embodiment of the fuel injection valve according to the present invention.

FIG. 1 is a schematically depicted axial section through an exemplary embodiment of a fuel injection valve 1 according to the present invention. The fuel injection valve 1 can in particular serve as an injector for fuel injection systems of mixture-compressing auto-ignition engines. In particular, the fuel injection valve 1 is suitable for commercial vehicles or passenger vehicles. A preferred use of the fuel injection valve 1 is for a fuel injection system equipped with a common rail that conveys highly pressurized diesel fuel to a plurality of fuel injection valves 1. However, the fuel injection valve 1 according to the present invention is also suitable for other practical applications.

The fuel injection valve 1 has a valve housing 4 composed of a first housing part 2 and a second housing part 3. The first housing part 2 is embodied in the form of an injector body 2 and second housing part 3 is embodied in the form of a nozzle body 3. In addition, the fuel injection valve 1 has a valve seat body 5 that is integrally joined to the second housing part 3. The valve seat body 5 is provided with a valve seat surface 6 that cooperates with a valve closing body 8 that can be actuated by a valve needle 7 to form a sealing seat. The valve closing body 8 is integrally joined to the valve needle 7.

The valve needle 7 has a valve needle piston 9 that is guided in a valve needle guide 14 of the second housing part 3. The valve needle 7 is essentially situated inside the second housing part 3.

The first housing part 2 of the fuel injection valve 1 has a fuel inlet fitting 10, which is shown in simplified fashion, to which a fuel line (not shown) can be connected in order to connect the fuel injection valve 1 to a common rail or another device. The fuel inlet fitting 10 has a fuel conduit 11 via which fuel can be conveyed into an inner chamber 12 of the valve housing 4 of the fuel injection valve 1. The inner chamber 12 is predefined by the first housing part 2 and the second housing part 3. In addition, the second housing part 3 also contains a fuel chamber 13 that communicates with the inner chamber 12 via through openings 15, 16 provided in the valve needle guide 14 so that the fuel introduced into the fuel injection valve 1 via the fuel conduit 11 travels into the fuel chamber 13 via the inner chamber 12 and the through openings 15, 16. For example, the pressure of the fuel can be 200 MPa (2000 bar).

A piezoelectric actuator 17 that is composed of several layers is situated in the inner chamber 12 of the valve housing 4. At one end, the actuator 17 is attached to an actuator foot 18 that rests against an inside 19 of the first housing part 2. On its side oriented away from the actuator foot 18, the first housing part is provided with an electrical connection point 20 at which an electrical supply line (not shown) can be connected to the fuel injection valve 1 in order to connect electric lines 21, 22 to a control unit or the like via the electrical supply line. The electric lines 21, 22 are routed through the first housing part 2 and the actuator foot 18 into the inner chamber 12 of the valve housing 4 and, by means of electric contacts 23, 24, are connected to the active layers of the actuator 17. At the other end, the actuator 17 is attached to an actuator head 30. When a control voltage is applied to the actuator 17, the actuator 17 is charged so that it expands in an axial direction 31 in opposition to the force of a valve spring 32; by means of the actuator head 30 and a pressure plate 33, the actuator 17 moves a valve piston 34 in the axial direction 31.

In the exemplary embodiment shown in FIG. 1, the charging of the actuator 17 produces the starting position of the valve piston 34 shown in FIG. 1 in which the fuel injection valve 1 is in the closed state, as will be explained in greater detail below.

At its end oriented away from the pressure plate 33, the valve piston 34 is guided in a control chamber sleeve 35 whose edge 36 rests against a throttle plate 37, thus forming a control chamber 38. The control chamber sleeve 35 is acted on by the valve spring 32, which rests against a pressure plate 33 at one end and rests against an end surface of the control chamber sleeve 35 at the other end. When the fuel injection valve 1 is not being actuated, the control chamber 38 contains highly pressurized fuel.

The control chamber 38 communicates with an additional control chamber 40 via a throttle 39 provided in the throttle plate 37. The control chamber 40 is formed by the valve needle piston 9, the throttle plate 37, and an additional control chamber sleeve 41 whose edge 42 at one and rests against the throttle plate 37 and whose other end is acted on by an additional valve spring 43. The valve spring 43 rests against the control chamber sleeve 41 at one end and at the other end, rests against an annular element 44 that is attached to the valve needle piston 9. In the starting position shown, in which the fuel injection valve 1 is closed, the combustion chamber 40 contains highly pressurized fuel.

The valve piston 34, the control chamber sleeve 35, the throttle plate 37, the control chamber sleeve 41, the valve needle piston 9, and the valve springs 32, 43 are part of a hydraulic coupler 45. The hydraulic coupler 45 compensates for length changes of the components of the fuel injection valve 1 due to temperature changes, in particular during operation of the fuel injection valve 1. In this case, respective leakage gaps are situated between the valve piston 34 and a control chamber sleeve 35 as well as between the valve needle piston 9 and a control chamber sleeve 41, which permit an inflow and outflow of fuel over a period of time that is long in comparison to an actuation cycle.

In order to actuate the fuel injection valve 1, the actuator 17 is discharged by reducing the control voltage so that the actuator contracts in the direction opposite from the axial direction 31. The force of the valve spring 32 causes the piston 34 connected to the pressure plate 33 to move in the direction opposite from the axial direction 31 so that the pressure of the fuel in the control chamber 38 drops significantly. But because of the resulting pressure difference, a pressure compensation between the control chamber 40 and the control chamber 38 occurs via the throttle 39, thus also reducing the pressure of the fuel in the control chamber 40. The force, which acts on a pressure shoulder 50 on the valve needle piston 9 of the valve needle 7 and is generated by the high pressure of the fuel in the fuel chamber 13, then prevails over the opposing force, which is composed of the force of the valve spring 43 and the force that the pressure of the fuel in the control chamber 40 exerts on the valve needle piston 9. As a result, the valve needle piston 9 moves in the direction opposite from the axial direction 31 so that the valve closing body 8 connected to the valve needle 7 lifts away from the valve seat surface 6 provided in the valve seat body 5, thus opening the sealing seat formed between the valve seat surface 6 and the valve closing body 8. As a result, fuel from the fuel chamber 13 can be injected through the opened sealing seat and the injection port 52 into a combustion chamber (not shown) of an engine.

In order to close the fuel injection valve 1, the actuator 17 is charged again by increasing the control voltage so that the actuator 17 expands in the axial direction 31 and, due to the corresponding movement of the valve piston 34, the pressure of the fuel in the control chamber 38 increases again. As a result, the fuel flows out of the control chamber 38 via the throttle 39 into the control chamber 40 so that the pressure of the fuel in the control chamber 40 also increases. As soon as the force, which is composed of the force of the valve spring 43 and the force on the valve needle piston 9 exerted by the pressure of the fuel in the control chamber 40, exceeds the force generated by the pressure of the fuel acting via the pressure shoulder 50 and on the valve closing body 8 on the valve needle 7, the valve needle 7 moves in the axial direction 31 into the initial position depicted in FIG. 1 in which the fuel injection valve 1 is once again closed.

The first housing part 2 is connected to the second housing part 3 in a connecting region 60. For this connection, a housing wall 61 of the first housing part 2 has an external thread 62 that engages with an internal thread 63 of a retaining nut 64. The second housing part 3 has a housing wall 65 and the retaining nut 64 engages behind a shoulder 66 provided on the housing wall 65. When the retaining nut 64 is screwed onto the thread 62 of the first housing part 2, the retaining nut 64 rests against the shoulder 66 so that a connecting force acts on the first housing part 2 in the axial direction 31 toward a conical support shoulder 67 of the second housing part 3. In the region of the conical support shoulder 67 provided on the housing wall 65 of the second housing part 3, the cross section, in particular the diameter, of the inner chamber 12 of the valve housing 4 decreases in the axial direction 31.

The components of the fuel injection valve 1 that require a large installation space are accommodated in the region of the large cross section of the inner chamber. For example, the actuator 17, the valve spring 42, the control chamber sleeve 35, the valve piston 34, and the throttle plate 37 require a large installation space. In order to optimize the outer diameter of the valve housing 4 of the fuel injection valve 1, the housing wall 61 of the first housing part 2 has a reduced outer diameter in the connecting region 60. The diameter of the inner chamber 12 that is predefined by the first housing part 2, however, is constant in the axial direction 31 so that the wall thickness of the first housing part 2 is reduced in the connecting region 60. The high pressure of the fuel in the inner chamber 12 consequently generates high stresses in the housing wall 61 of the first housing part 2 in the connecting region 60. Consequently, the open end of the first housing part 2 of the valve housing 4 in the connecting region 60 represents a weak point in the design with regard to tightness and strength. According to the present invention, therefore, the housing wall 61 of the first housing part 2 rests at least indirectly against the housing wall 65 of the second housing part 3 in the radial direction 68. In addition, the housing wall 65 of the second housing part 3 is reinforced in the connecting region 60. Consequently, the housing wall 65 of the second housing part 3 absorbs the stresses that the high pressure of the fuel generates in the connecting region 60 of the housing wall 61 of the first housing part 2, thus eliminating the above-mentioned weak point. In particular, the pressure of the fuel in the inner chamber 12 can be increased significantly and, for example, can assume values of 200 MPa (2000 bar). The sealing action between the housing wall 61 of the first housing part 2 and the housing wall 65 of the second housing part 3 is produced on the one hand by the clamping force of the retaining nut 64 exerted in the axial direction 31. On the other hand, the pressure of the fuel in the inner chamber 12 also acts on the housing wall 61 of the first housing part 2 in the radial direction 68 toward the conical support shoulder 67, thus producing an additional self-amplifying sealing action.

In order to further improve the strength in the connecting region 60, the housing wall 65 of the second housing part 3, at least in the region of the conical support shoulder 67, can be made of a material with an increased strength.

The stresses that occur are further reduced by the embodiment of the retaining nut 64. The geometrical design of the retaining nut 64 is determined by means of a finite element method so that stress peaks are avoided and a uniform stress load occurs that additionally reduces the stresses generated by the internal pressure. In particular, the force distribution in the engagement region of the threads 62, 63 is improved in that the retaining nut 64 has a narrower wall thickness in the region 69 of the front engaged thread turns than in the region 70 of the rear engaged thread turns, which can be achieved, for example, by the bulging design of the retaining nut 64 in the connecting region 60 depicted in FIG. 1.

The invention is not limited to the above-described exemplary embodiments. In particular, the invention is also suitable for a fuel injection valve 1 that has a valve housing 4 composed of more than two housing parts 2, 3. In addition, the invention is also suitable for fuel injection valves 1 with other actuating mechanisms. In particular, the hydraulic coupler 45 that is embodied as a distance booster in the exemplary embodiment can also be embodied in the form of a force booster or can merely perform the function of temperature compensation.

The foregoing relates to a preferred exemplary embodiment of the invention, it being understood that other variants and embodiments thereof are possible within the spirit and scope of the invention, the latter being defined by the appended claims.

The invention claimed is:

1. A fuel injection valve for fuel injection systems of air-compressing auto-ignition internal combustion engines, having a valve housing that is composed of a first housing part and at least one second housing part and in which a housing wall of the first housing part is at least indirectly connected in a connecting region to a housing wall of the second housing part, wherein, in the connecting region, the housing wall of the first housing part rests at least indirectly against the housing wall of the second housing part, at least in a radial direction, wherein the housing wall of the second housing part is embodied as reinforced, at least in the connecting region, wherein the housing wall of the first housing part and the housing wall of the second housing part delimit an inner chamber of the valve housing that contains highly pressurized fuel during operation of the fuel injection valve, the inner chamber being disposed inside of the first housing part and the second housing part in a manner which conveys the fuel directly from the first housing part past the connecting region and into the second housing part of the valve housing via the inner chamber without any additional fuel conduit, wherein the second housing part contains a fuel chamber that communicates with the inner chamber, wherein the second housing part comprises a support shoulder, and wherein the first housing part rests against the support shoulder, and wherein the support shoulder is embodied as of a conical support shoulder.

2. The fuel injection valve according to claim 1, further comprising a retaining nut connecting the first housing part to the second housing part.

3. The fuel injection valve according to claim 2, wherein the first housing part comprises an external thread, and the retaining nut comprises an internal thread, the internal thread of the retaining nut engaging the external thread of the first housing part in order to connect the first housing part to the second housing part the retaining nut being embodied so as to produce an at least approximately uniform transmission of force by means of engaged thread turns of the first housing part and the retaining nut.

4. The fuel injection valve according to claim 3, wherein a wall of the retaining nut is thicker in a beginning portion of the internal thread of the retaining nut than in an end portion thereof.

5. The fuel injection valve according to claim 3, wherein the second housing part is embodied as a nozzle body.

6. The fuel injection valve according to claim 2, wherein the second housing part is embodied as a nozzle body.

7. The fuel injection valve according to claim 1, wherein the second housing part is embodied as a nozzle body.

8. The fuel injection valve according to claim 1, wherein the connecting region, the second housing part has a greater wall thickness than the first housing part.

9. The fuel injection valve according to claim 1, wherein the second housing part is composed of a material that has a higher strength than a material of the first housing part.

* * * * *